United States Patent [19]

Sanders

[11] Patent Number: 4,706,536

[45] Date of Patent: Nov. 17, 1987

[54] MEMBRANE KEYBOARD FOR SONGBOOK TONE GENERATOR

[75] Inventor: Sam Sanders, Nashville, Tenn.

[73] Assignee: JTG of Nashville, Inc., Nashville, Tenn.

[21] Appl. No.: 826,299

[22] Filed: Feb. 5, 1986

[51] Int. Cl.[4] ..... G10H 1/34; G10H 5/00

[52] U.S. Cl. ..... 84/1.01; 84/423 R; 84/433; 84/471 R; 84/483 R; 84/DIG. 7; 200/5 A

[58] Field of Search ..... 84/1.01, 423 R, 433, 84/471 R, 483 R, DIG. 7; 200/5 R, 5 A, 6 R

[56] References Cited

U.S. PATENT DOCUMENTS

| | | | |
|---|---|---|---|
| 3,592,098 | 7/1971 | Zadig | 84/DIG. 7 |
| 4,276,538 | 6/1981 | Eventoff et al. | 84/DIG. 7 |
| 4,366,463 | 12/1982 | Barker | 84/DIG. 7 |

*Primary Examiner*—Stanley J. Witkowski
*Attorney, Agent, or Firm*—David B. Harrison

[57] ABSTRACT

A membrane keyboard for e.g. a low cost electronic tone generator of the type affixed to the binding of a songbook is disclosed. The keyboard includes a base carrying a set of interdigital upwardly facing printed circuit contacts for each key. A membrane overlay is vacuum formed of a thin plastic sheet to define a horizontal row of playing keys, each key being formed as a plateau area, with a vertical depression spring rib separating each key. Each key includes an elastomeric foam pad affixed to its underside area which carries a conductive lower surface aligned with with the interdigital traces of the key. The conductive surface bridges the traces to complete an electrical circuit when the membrane is depressed downwardly from its top surface.

7 Claims, 7 Drawing Figures

MEMBRANE KEYBOARD FOR SONGBOOK TONE GENERATOR

FIELD OF THE INVENTION

The present invention relates to electrical membrane switches. More particularly, the present invention relates to an improved, low cost electrical membrane switch keyboard for inclusion within an electronic tone generator of the type suitable to be included inside a songbook.

BACKGROUND OF THE INVENTION

With the advent of very low cost electronic integrated circuit technology, it has become practical to include a functional electronic tone generator device within and as an integral part part of a publication, such as a songbook containing songs suitable for play upon a keyboard of the tone generator device. Such tone generator devices have typically been very low cost, self contained, battery operated "throwaway" units. The typically have included a housing usually formed of a molded plastic material, a printed circuit card base carrying a power source such as a battery formed of a plurality of mercuric oxide cells, an integrated circuit tone generator, an audio tone transducer and a matrix of sets of typically interdigitated conductive traces forming a keyboard layout. The keyboard was completed in accordance with conventional membrane switch technology by providing a thin, continuous plastic film sandwich overlay for the keyboard layout, with conductive material disposed in the areas adjacently facing the sets of conductive traces. A spacing film between the surface carrying the conductive material and the printed circuit card had openings at each conductive area and functioned to hold the conductive area away from the underlying and oppositely facing traces. When the conductive film was depressed by the finger, the conductive material completed the contact between the interdigitated fingers of the traces of the set, and a tone was generated and reproduced aurally by the transducer. Thus, the tone generator could be used in the songbook in order to play the notes of the tunes printed therein.

One drawback of the prior art approach was that the thin film spacer could effectively provide for openings (active contact regions of the key) which were relatively small. Such small openings, and corresponding small areas of exposed conductive material required considerable dexterity on the part of the player to pick out the precise portion of each key which was active. With small children, such keyboards proved unreliable because the children were unable effectively to depress each key and thereupon became quickly frustrated with the songbook.

Another drawback of the prior art was the closeness of the spacing between each of the interdigitated fingers of each key. Such close spacing, together with typical very high input impedances of the low power (CMOS) electronic tone generator circuit, made it particularly susceptible to moisture. Humidity, or other moisture penetrating the keyboard, caused it to turn on and remain on, thereby depleting the power source and effectively ending the usefulness of the entire device.

SUMMARY OF THE INVENTION WITH OBJECTS

A general object of the present invention is to provide a membrane keyboard for a songbook tone generator which overcomes limitations and drawbacks of the prior art.

A specific object of the present invention is to provide an improved membrane keyboard which provides an active surface extending substantially throughout the area of each key.

Another specific object of the present invention is to provide an improved membrane keyboard which is made operative and reliable by spring ribs formed in the plastic membrane between each key.

One more specific object of the present invention is to attach a membrane keyboard including vertical spring ribs along one of its edges to a housing supporting an adjacently underlying printed circuit contact matrix and retain the membrane of the keyboard in position by contact of a housing edge with a spring edge of the membrane opposite the one edge secured to the housing.

A further specific object of the present invention is to provide an improved membrane keyboard which may be manufactured at very low cost with readily available materials and which works reliably over the useful life of the tone generator in which it is incorporated.

An electronic tone generator of the type incorporated into the binding of a songbook includes the improved keyboard of the present invention. Typically, the generator includes a housing for securing interconnected parts including the finger operable keyboard, an electronic tone generator circuit, a power source and an audio tone transducer. The improved keyboard includes a base carrying a set of interdigital upwardly facing printed ciruit traces for each key, the sets being arranged in a horizontal row. A membrane overlay is typically vacuum formed of thin thermoplastic sheet material to define a horizontal row of playing keys, each key being formed as a plateau area, and having a vertical depression spring rib separating each key from each adjacent key. Each depression spring rib is aligned to contact the base and maintain the adjacent plateau areas above corresponding sets of traces and to provide resilience enabling each plateau area to be depressed by a finger and thereby facilitate physical contact with the base. Each key includes an elastomeric foam pad affixed to and occupying substantially the entirety of the underside of each plateau. The pad carries an electrically conductive material on a surface thereof oppositely facing and slightly spaced away from a corresponding set of interdigital traces.

In one specific aspect, the keyboard membrane includes a lower edge hinge attached to the housing of the keyboard and a top flat continuous horizontal spring edge even with the plateaus, the continuous edge being depressed by a top cover portion of the housing in order to bias the membrane towards the base and maintain the spring ribs in contact therewith.

In another aspect, the electrically conductive material comprises a thin metal foil.

These and other objects, advantages and features of the present invention will be more apparent to those skilled in the art upon consideration of the following detailed description of a preferred embodiment, presented in conjunction with the accompanying drawings.

DETAILED DESCRIPTION OF A PREFERRED EMBODIMENT

Figure 1:
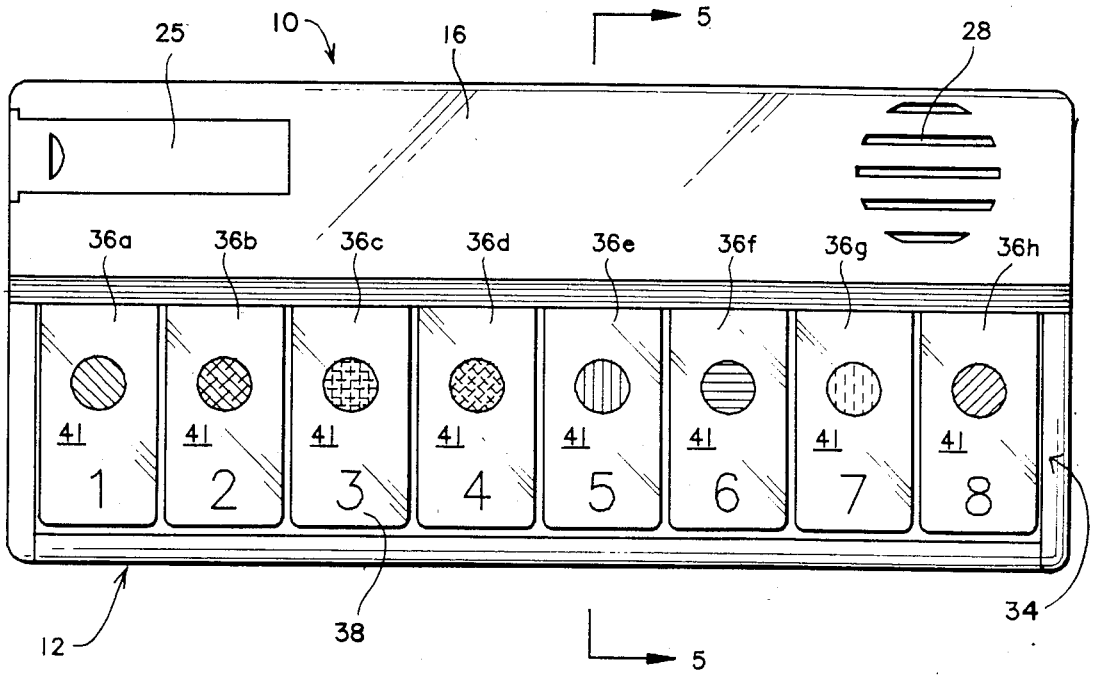
FIG. 1 is a top plan view of a songbook tone generator incorporating a keyboard in accordance with the principles of the present invention.
Figure 2:
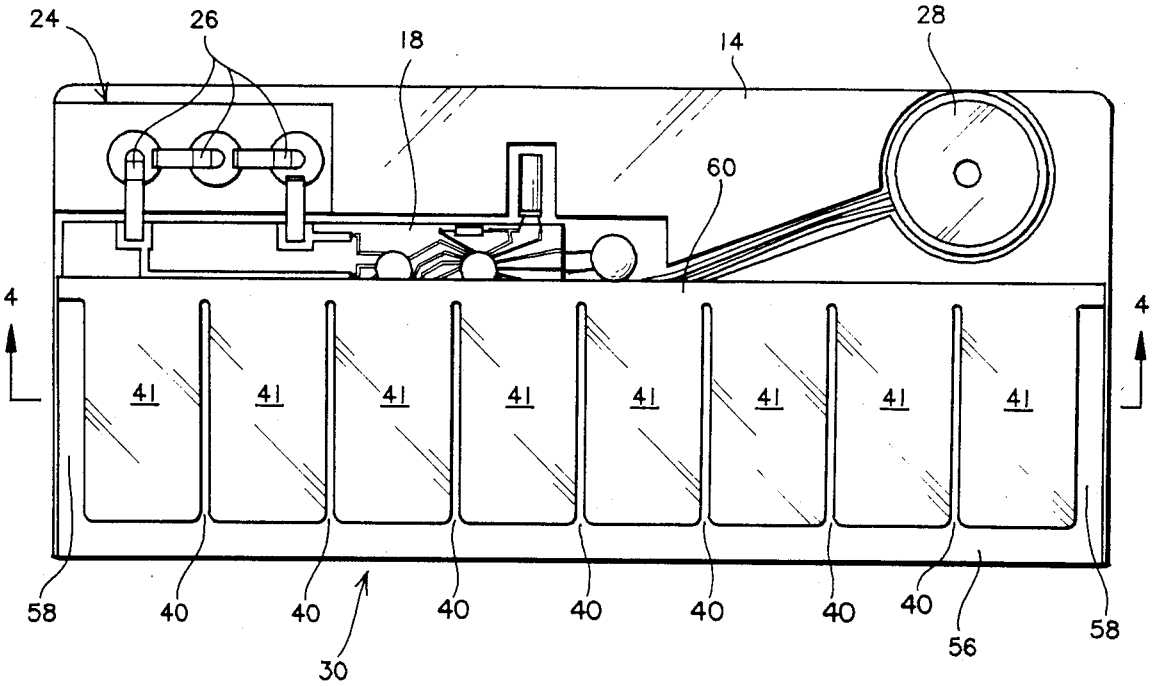
FIG. 2 is a top plan view of the generator depicted in FIG. 1 with the top cover removed.
Figure 3:
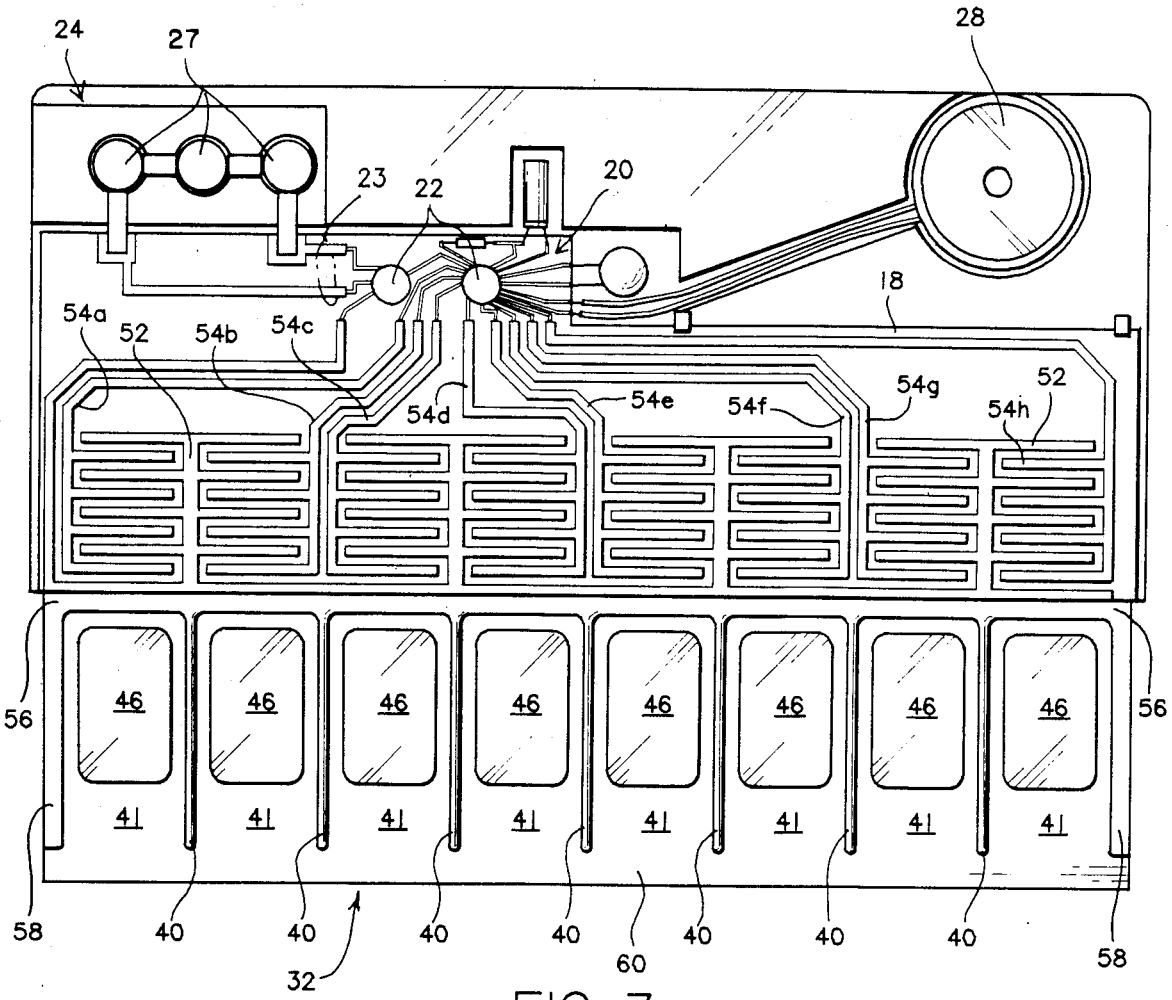
FIG. 3 is a top plan view of the generator depicted in FIG. 2 with the keyboard top membrane folded back along the bottom edge in order to illustrate the printed circuit base.

A songbook tone generator 10 incorporating the principles of the present invention is illustrated in the figures. Therein, the generator 10 includes a housing 12 including a base 14 and a top cover 16, both molded of a suitable rigid thermoplastic material, such as polyethylene, polyvinyl, polystyrene, etc. The housing encloses a printed circuit board 18 which edge mates with a hybrid circuit 20 carrying one or more integrated circuits 22 which are adapted to generate tones. Solder bridges 23 are used to attach the hybrid circuit 20 to the printed circuit board 18 and to connect the circuits together. The base 14 also defines a multi-cell battery holder 24 for holding a plurality of mercuric oxide power cells 27, as shown in FIG. 3. A cell lid 25 in the top cover provides ready access to the cells by the user, and retains the cells 27 in contact with suitable connector springs 26 (shown in FIG. 2.) which enable each cell to be connected to the others in series, and to the circuit board 18. A low profile tone transducer 28 is connected to the hybrid circuit 20 and converts electrical energy into audible tones.

A keyboard 30 is formed by the printed circuit board 18 in combination with a thin film plastic membrane 32 which is molded upon application of heat and vacuum against a suitable die. As molded, the membrane 32 defines a horizontal row 34 of keys 36. Eight such keys are shown, 36*a*, 36*b*, 36*c*, 36*d*, 36*e*, 36*f*, 36*g*, 36*h*. The top surface 38 of each key is conventionally made a different color to facilitate correlation between notes in an accompanying songbook (not shown) and keys of the keyboard. This color shading is shown by the circular insets for each key surface 38 and in practice the color extends throughout the entirety of each surface. Each key is also numbered to correspond to numbers for notes appearing in the accompanying songbook in which the tone generator 10 is mounted, typically to the inside back cover of the book, below the printed pages.

A vertical depression or rib 40 separates each key from every other adjacent key 36 in the row 34 and forms plateau areas 41 which are adjacently spaced above the printed circuit board 18. The rib 40 acts as a spacer, and it also acts as a spring, enabling the plateau area 41 of the membrane key 36 to be depressed and come into physical contact with the underlying printed circuit board 18.

Figure 4:
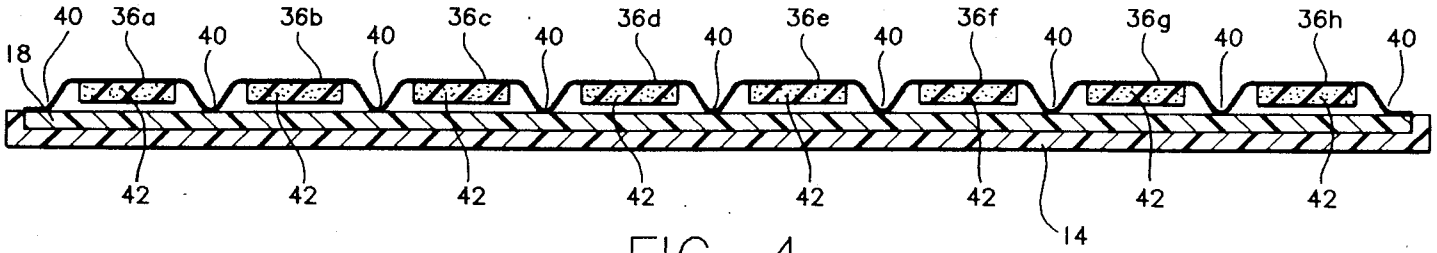
FIG. 4 is a sectional view in elevation of the keyboard taken along the line 4—4 in FIG. 2.
Figure 6:
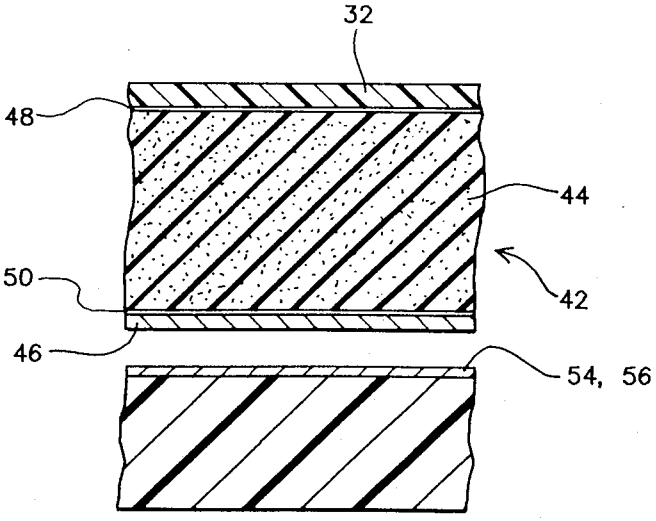
FIG. 6 is an enlarged sectional view in elevation of a portion of the keyboard as shown in FIG. 4.
Figure 5:
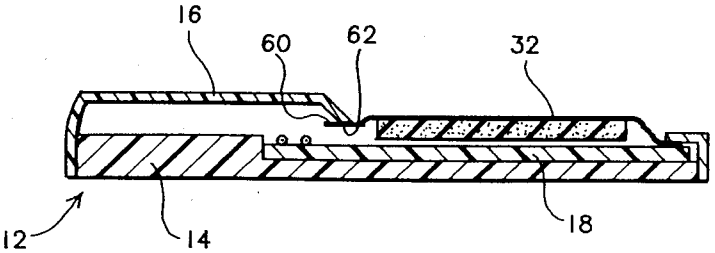
FIG. 5 is a sectional view in elevation of the generator taken along the line 5—5 in FIG. 1.

As seen best in FIGS. 3,4 and 6, each key 36 includes a contact pad 42. The pad 42 is of a composite sandwich construction and includes a compressible foam pad 44 and a metallic contact making surface 46. The pad 44 is secured to the underside of the membrane 32 by an adhesive layer 48, and surface metal surface 46 is secured to the pad by an adhesive layer 50. Preferably, the foam pad 44 is formed of a closed cell, double adhesive coated foam tape such as Mounting Tape manufactured by Minnesota Mining and Manufacturing Co. (3M), St. Paul, Minn. 55133, Catalog No. 114 or equivalent. A suitable metal foil such as metal duct tape provides a the metal surface 46. The pad 44 is sized so that it occupies a substantial portion of the membrane 32 defining each key 36. In its undepressed state the pad 44 is closely spaced away from the top surface of the printed circuit board 18, as shown in the FIG. 5 cross-sectional view.

The printed circuit board 18 includes a matrix array of interdigitated contact traces 52, 54. The traces 52 form four pairs of "trees" and represent the common or return electrical connection path for all of the keys 36. A separate set of traces 54 is provided for each key, and in the generator 10 there are eight such sets 54*a*, 54*b*, 54*c*, 54*d*, 54*e*, 54*f*, 54*g*, and 54*h*. The traces of each set 52, 54 are spaced apart and cover substantially the entire area of each key, thereby enabling the player to depress the key over a wide area of the surface thereof and still cause a portion of the metallic foil surface 46 of the key 36 to bridge across and thereby connect the unique set 54 with the common set 52, thereby causing the circuitry 22 to generate a tone which is made audible by the transducer 28.

The membrane 32 includes a lower bottom continuous peripheral edge 56 which is bonded or otherwise secured to the base 14 adjacently along the lower edge of the top of the printed circuit board 18. Two lower side edges 58 of the membrane overlie the vertical edges of the printed circuit board 18. A raised continuous top peripheral edge 60 of the membrane is contacted by a horizontal surface 62 of the top cover 16. The flat top edge 60 acts as a hinge spring, and the downward contact of the surface 62 against the top edge 60 causes the vertical ribs 40 of the membrane 32 to rest against the printed circuit board 18 so that the metallic surface 46 of each key is thereby spaced closely away from the corresponding sets of interdigitated finger contacts 52, 54.

Figure 7:
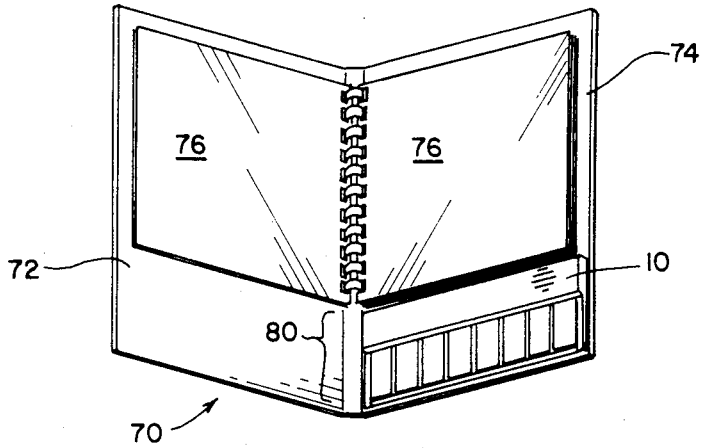
FIG. 7 is a diagrammatic isometric view of a typical songbook with which the songbook tone generator depicted in FIGS. 1–6 may be attached and used.

A hard cover songbook 70 is illustrated in FIG. 7. Therein, the songbook includes a front hard cover 72, a back hard cover 74 and pages 76 which are bound to a spine 78 of the book 70 by any suitable bindery. The pages 76 are sized so as to leave a space, denoted by the reference numeral 80, below the pages and enclosed by the front cover 72 and back cover 74 when the book 70 is closed. As shown in FIG. 7, one convenient location for the songbook tone generator is the space 80. The tone generator 10 may be attached to the inside of the back cover 74 of the songbook 70 by adhesive or by double faced pressure sensitive adhesive tape strips. In the space 80, the keyboard 30 may be used as the songbook is being read by the user.

To those skilled in the art, many widely varying embodiments and modifications will be readily apparent without departure from the spirit of the present invention. The disclosures herein are purely illustrative and should not be construed as limiting the scope of the present invention, as more particularly set forth in the following claims.

I claim:

1. In an electronic tone generator of the type incorporated into the binding of a songbook, the generator including a housing for securing interconnected parts including a finger operable keyboard, an electronic tone generator circuit, a power source and an audio tone transducer, an improved direct electrical contact-providing keyboard comprising:

a printed circuit base means for mounting said electronic tone generator circuit and for carrying a set of paired upwardly facing printed circuit traces, each pair of traces being arranged interdigitally and one of each of the pair of traces being electrically common for all keys, and the other of each of the pair of traces being electrically unique for each key, the pairs being arranged in a horizontal row and being in electrical connection with the electronic tone generator circuit, a membrane overlay vacuum formed of thin thermoplastic sheet material to define a horizontal row of playing keys directly overlying and contiguous with the set of paired printed circuit traces, each key being formed as a plateau area, and having a vertical depression spring rib separating each key from each adjacent key, the depression spring rib aligned to contact the base means and maintain the adjacent plateau areas above corresponding pairs of traces and to provide resilience enabling each plateau area to be depressed by pressure from a finger thereby to facilitate physical contact with the base means and to return to its original location upon removal of said finger pressure, each pair of interdigital traces being sized and spaced to extend substantially throughout the finger contact area of its corresponding key, each key including an elastomeric foam pad having a dimension substantially coextensive with and affixed to the underside of each plateau area and carrying an electrically conductive material substantially over the entirety of a surface thereof which is oppositely facing and slightly spaced away from a corresponding pair of interdigital traces.

2. The electronic tone generator as set forth in claim 1 wherein said membrane overlay includes a bottom edge hinge attached to said base means and a top flat continuous horizontal spring edge even with said plateau areas, said horizontal spring edge being depressed by a top cover portion of said housing in order to bias said membrane overlay towards said base means and maintain said ribs in contact therewith.

3. The electronic tone generator as set forth in claim 1 wherein said electrically conductive material comprises a thin metal foil.

4. The electronic tone generator as set forth in claim 1 wherein the housing includes a multi-cell battery holder for holding and connecting power cells and a cell lid for enclosing the battery holder, the cell lid being accessible to the user.

5. A low cost electronic tone generator for a songbook including a plastic base for mounting and aligning a multi-cell battery holder, a cover, an audio tone sound transducer, and printed circuit board means for mounting and connecting the multi-cell battery holder and the audio tone sound transducer, the printed circuit board means including a keyboard region, the keyboard region carrying a set of paired, upwardly facing printed circuit traces, each pair of traces being arranged interdigitally and one of each of the pair of traces being electrically common for all keys, and the other of each of the pair of traces being electrically unique for each key, the pairs being arranged in a horizontal row and being in electrical connection with the electronic tone generator circuit, so that if any portion of a pair is bridged electrically, a tone is generated and transduced by the audio tone sound transducer, the keyboard region being overlayed by a membrane overlay vacuum formed of thin thermoplastic sheet material to define a horizontal row of playing keys with each key overlaying a corresponding pair of interdigitally arranged printed circuit traces, each key being formed as a plateau area, and having a vertical depression spring rib separating each key from each adjacent key, the depression spring rib aligned to contact the printed circuit board means and to maintain the adjacent plateau areas above corresponding pairs of traces and to provide resilience enabling each plateau are to be depressed by pressure from a finger thereby to facilitate a physical contact of the plateau area with the printed circuit board means and to return the plateau area to its original location when finger pressure is removed, the membrane being secured to the printed circuit board means and framed by the cover, each pair of interdigital traces being sized and spaced to extend substantially throughout the finger contact area of its overlying corresponding key, each key including an elastomeric foam pad having a dimension substantially coextensive with and affixed to the underside of each plateau and having an electrically conductive surface thereof which is oppositely facing and slightly spaced away from a corresponding pair of interdigital traces, whereby, when finger pressure depresses a portion of a key, a portion of the electrically conductive material of the key bridges across adjacent portions of the pair of traces for the key, thereby completing an electrical circuit to the tone generator means.

6. The low cost electronic tone generator for a songbook set forth in claim 5 wherein said elastomeric foam pad has a thickness dimension which establishes the modulus of elasticity of the membrane at each plateau area.

7. The low cost electronic tone generator for a songbook set forth in claim 6 wherein the electrically conductive surface of each elastomeric foam pad comprises a thin conductive metal foil secured thereto.

* * * * *